US009968175B2

(12) United States Patent
Nesbitt

(10) Patent No.: US 9,968,175 B2
(45) Date of Patent: May 15, 2018

(54) APPLICATOR FOR A LIQUID OR VISCOUS COSMETIC AND THE ASSOCIATED PACKAGING ASSEMBLY THEREOF

(71) Applicant: ALBEA SERVICES, Gennevilliers (FR)

(72) Inventor: Kyle Nesbitt, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 0 days. days.

(21) Appl. No.: 14/963,330

(22) Filed: Dec. 9, 2015

(65) Prior Publication Data

US 2016/0166045 A1 Jun. 16, 2016

(30) Foreign Application Priority Data

Dec. 15, 2014 (FR) ..... 14 62458

(51) Int. Cl.

| | |
|---|---|
| ***A45D 34/04*** | (2006.01) |
| ***A46B 9/02*** | (2006.01) |
| ***A45C 13/00*** | (2006.01) |
| ***A46B 3/00*** | (2006.01) |

(Continued)

(52) U.S. Cl.

CPC ..... *A45D 34/045* (2013.01); *A45C 13/005* (2013.01); *A46B 3/005* (2013.01); *A46B 9/005* (2013.01); *A46B 9/021* (2013.01); *A45C 2005/037* (2013.01); *A46B 2200/20* (2013.01); *A46B 2200/205* (2013.01)

(58) Field of Classification Search

CPC ..... A45D 34/042; A45D 34/045; A46B 1/00; A46B 9/021; A46B 9/005; A46B 9/02

See application file for complete search history.

(56) References Cited

U.S. PATENT DOCUMENTS 2,279,520 A * 4/1942 Perillo ..... A45D 34/042 132/74.5
2,291,676 A * 8/1942 Baker ..... A45D 40/265 401/130

(Continued)

FOREIGN PATENT DOCUMENTS

EP 0693263 A1 1/1996

OTHER PUBLICATIONS

FR App No. 1462458, International Search Report, dated Oct. 2, 2015.

*Primary Examiner* — Jennifer C Chiang
*Assistant Examiner* — Bradley Oliver
(74) *Attorney, Agent, or Firm* — Banner & Witcoff, Ltd.

(57) ABSTRACT

An applicator for a liquid or viscous cosmetic and packaging assembly thereof. The applicator extends in a longitudinal extension direction (X) and comprises a distal end and a proximal end. The applicator comprises an end piece, at the proximal end, which can be attached to a rod of an applicator assembly, a spatula at the distal end, and a base which connects the end piece and the spatula. The end piece, the base, and the spatula being a single piece made of a polymer material. The spatula comprises at least two tongues, each having an end connected to a solid portion of the spatula and an opposite end, and at least two applicator tabs formed in the extension of each tongue in the region of the opposite end, each tab having a free end which forms the distal end of the applicator.

13 Claims, 2 Drawing Sheets

(51) Int. Cl.
*A46B 9/00* (2006.01)
*A45C 5/03* (2006.01)

(56) References Cited

U.S. PATENT DOCUMENTS

| | | | | | |
|---|---|---|---|---|---|
| 5,888,005 | A * | 3/1999 | Gueret | A45D 34/046 | 401/119 |
| 6,026,824 | A * | 2/2000 | Gueret | A45D 40/267 | 132/218 |
| 6,331,085 | B1 * | 12/2001 | Schrepf | A45D 34/046 | 401/122 |
| D591,904 | S * | 5/2009 | Mongeon | D28/7 | |
| D643,151 | S * | 8/2011 | Limongi | D28/7 | |
| 2003/0213498 | A1 * | 11/2003 | Gueret | A46B 9/021 | 132/218 |
| 2006/0065282 | A1 * | 3/2006 | Hartstock | A45D 34/042 | 132/320 |
| 2006/0248669 | A1 * | 11/2006 | Dovellos | A46B 3/12 | 15/159.1 |
| 2007/0169790 | A1 * | 7/2007 | Castagno | A45D 19/0008 | 132/320 |
| 2008/0053474 | A2 * | 3/2008 | Mr. Castagno | A45D 19/0008 | 132/320 |
| 2011/0308031 | A1 * | 12/2011 | Hartstock | A46B 3/005 | 15/171 |
| 2015/0273517 | A1 * | 10/2015 | Beuer | A46B 1/00 | 15/207.2 |

* cited by examiner

APPLICATOR FOR A LIQUID OR VISCOUS COSMETIC AND THE ASSOCIATED PACKAGING ASSEMBLY THEREOF

CROSS REFERENCE TO RELATED APPLICATIONS

This application claims priority to French Application Serial No. 1462458, filed Dec. 15, 2014, which is hereby incorporated by reference in its entirety.

FIELD

The invention relates to an applicator for a liquid or viscous cosmetic, in particular nail varnish. Other applications may relate to eye shadows, eye liner or lip gloss for example.

Applicators for nail varnish of the "spatula" type are known which comprise, in place of a bundle of bristles, a flexible spatula made of plastics material, it being possible for said spatula to be solid or divided into tongues by means of longitudinal slits, the sleeve and the spatula constituting a single piece obtained by moulding.

However, a drawback of the applicators of the spatula type on the market today is the appearance of streaks on the nail when applying the nail varnish. When the spatula is divided into tongues, said streaks have the width of each of said tongues on the spatula and more particularly the width of said tongues at the distal end of the applicator. Indeed, the width of the tongues provides the spatula with a rigidity such that, when applying the varnish, streaks appear on the nail. A second drawback of the applicators of the spatula type lies in the fact that the tip of the spatula, over the entire length thereof, is very often straight or square, i.e. in a plane which is perpendicular to the longitudinal axis of the applicator, which results in less precise application of the varnish on the nail.

BACKGROUND

The object of the present invention is therefore to propose an applicator, in particular for nail varnish, which makes it possible to overcome these various drawbacks.

Therefore, the invention relates to an applicator for nail varnish, which extends in a longitudinal extension direction (X) and comprises a distal end, referred to as the distal end of the applicator $A_d$, and a proximal end, referred to as the proximal end of the applicator $A_p$, the applicator comprising:

- an end piece, at the proximal end $A_p$, which can be attached to a rod of an applicator assembly,
- a spatula at the distal end $A_d$,
- a base which connects the end piece and the spatula, the end piece, the base and the spatula being a single piece made of a polymer material, characterised in that the spatula comprises:

- at least two tongues, each having an end connected to a solid portion of the spatula and an opposite end,
- at least two applicator tabs formed in the extension of each tongue in the region of the opposite end, each tab having a free end which forms the distal end of the applicator.

The plurality of applicator tabs formed in the extension of each tongue are beneficial for a user wanting a uniform application (without streaks) over the entire application surface of the nail. Indeed, due to the smaller width thereof, each applicator tab can spread apart from one another when the user presses the spatula onto the nail, thus recreating the profile of the bundles of bristles and therefore a more uniform application of the product.

According to different embodiments of the invention, which may be taken together or separately:

- the tongues are wider than the applicator tabs,
- the ends of the tongues connected to the solid portion of the spatula are arranged in a plane perpendicular to the axis of extension X,
- the applicator has a certain degree of flexibility in the region of the tongues, said flexibility being even more accentuated in the region of the applicator tabs,
- the ends of the applicator tabs are arranged in an arc,
- there are three tongues and 5 applicator tabs,
- the spatula has a planar profile,
- the distal end of the applicator has a radius of curvature,
- the polymer material has a hardness of between 30 and 100 Shore A, preferably of between 50 and 85 Shore A,
- the polymer material is a thermoplastic elastomer material or a silicone material,
- the thermoplastic elastomer material is selected from the group comprising a thermoplastic olefin (TPO) polymer, an ethylene propylene diene monomer-polypropylene (EPDM-PP) copolymer, a styrene-butadiene-styrene (SBS) sequenced triblock copolymer, a styrene-ethylene/butylene-styrene (SEBS) sequenced copolymer, a thermoplastic polyurethane (TPU), a polyether block amide (PEBA) copolymer, an ethylene/alpha-olefin copolymer.

SUMMARY

The invention also relates to a packaging assembly for nail varnish, comprising:

- a receptacle containing nail varnish,
- a rod, at the proximal end $T_p$ of which is a cap that can be attached to a neck of the receptacle, and at the distal end $T_d$ of which there is an applicator as defined above.

The invention will be better understood, and its other aims, details, features and advantages will become more clearly apparent in the detailed explanatory description that follows of at least one embodiment of the invention given as a purely illustrative and non-limiting example, with reference to the accompanying schematic drawings.

DETAIL DESCRIPTION

Figure 1:
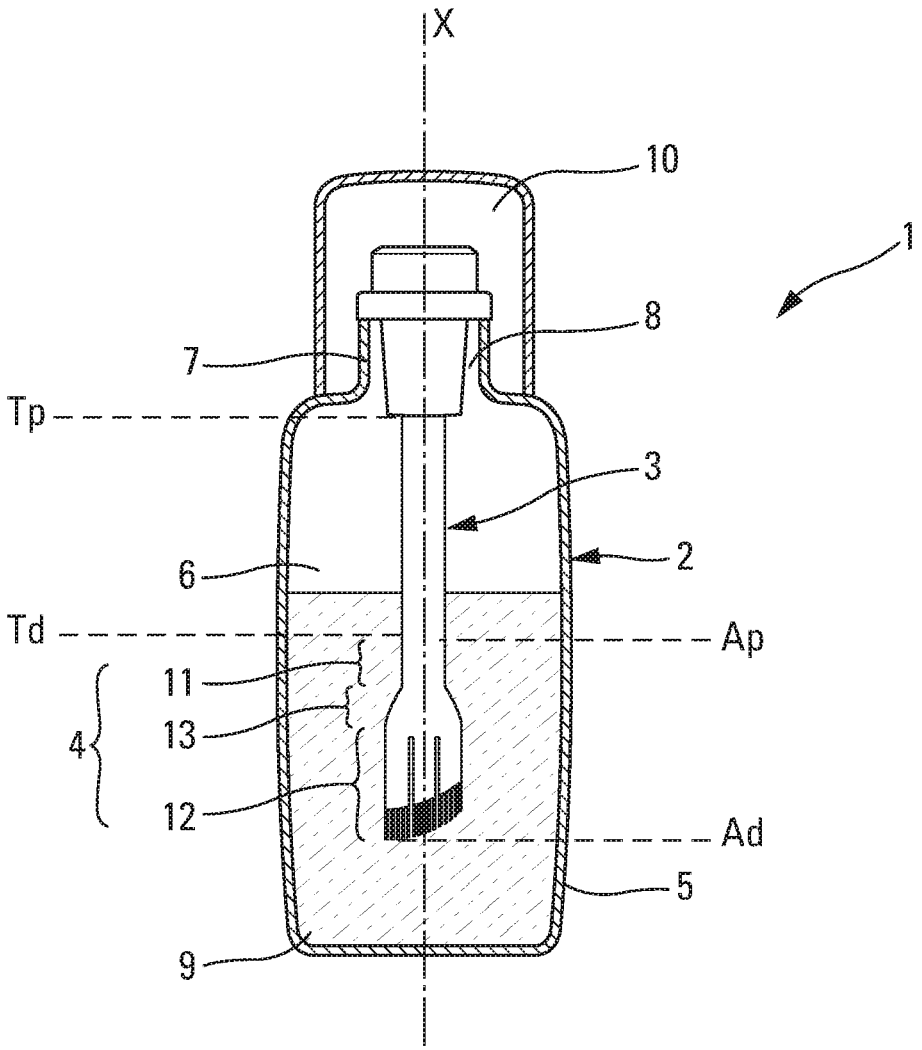
FIG. 1 schematically shows a packaging assembly for nail varnish according to the second embodiment of the invention.

In FIG. 1, the packaging assembly 1 for nail varnish comprises a receptacle 2, a rod 3 and an applicator 4.

In the example shown in FIG. 1, the receptacle 2 is a glass or plastics bottle comprising walls 5 which define an internal cavity 6 and a neck 7 which defines an opening 8. The internal cavity 6 contains nail varnish 9.

The nail varnish 9 is a solution consisting mainly of a mixture of ethyl acetate and butyl acetate. Indeed, said two components usually represent approximately 70 wt. % of the solution.

The rod 3 is made of a rigid polymer material, such as a polyolefin. The material can be selected from the polyethylenes or the polypropylenes.

The rod 3 has an elongate shape in a longitudinal extension direction X. The rod 3 comprises a first end, referred to as the proximal end of the rod $T_p$, which is suitable for being attached to a cap 10, and a second end, referred to as the distal end of the rod $T_d$, to which the applicator 4 is attached. Said cap 10 can be attached to a neck 7 of the receptacle 2, for example by screwing. When the cap 10 is attached to the receptacle 2, the rod 3 and the applicator 4 extend inside the internal cavity 6 of the receptacle 2. When the cap 10 is detached from the receptacle 2, the cap 10 acts as a handle allowing the user to grip said cap in order to use the applicator 4 located at the distal end of the rod $T_d$.

The rod 3 has an elongate portion which has a generally cylindrical shape of revolution and extends along the axis X, which also forms the axis of revolution of the portion.

Figure 2:
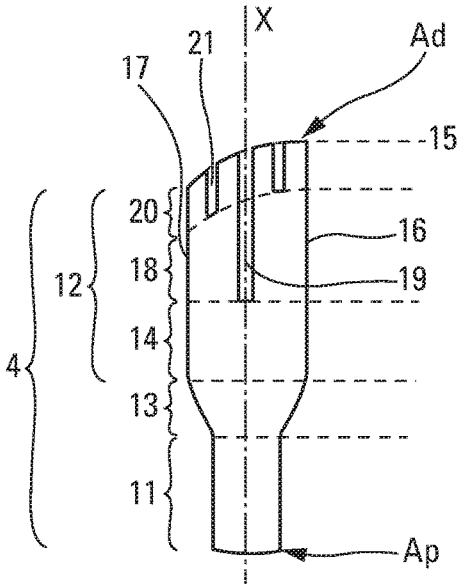
FIG. 2 is a schematic front view of an applicator of the spatula type according to a first embodiment of the invention.

FIG. 2 shows the applicator 4 according to a first embodiment of the invention. In particular, the applicator 4 extends in a longitudinal extension direction (X) and comprises a distal end, referred to as the distal end of the applicator $A_d$, and a proximal end, referred to as the proximal end of the applicator $A_p$. The applicator comprises an end piece 11, a spatula 12 and a base 13, said three elements being formed in a single piece from a polymer material.

The end piece 11, at the proximal end of the applicator $A_p$, has a generally cylindrical shape and can be attached to the distal end of the rod $T_d$ of the applicator assembly 1 in order to attach the applicator 4 to the rod 3. Along the axis X, the length of the end piece is of between 7 mm and 11 mm, preferably 9 mm, while the diameter thereof is of between 2 mm and 4 mm, preferably 3 mm.

The spatula 12 has a generally flattened shape, the thickness of which is of between 0.2 mm and 0.5 mm, preferably 0.38 mm. The spatula 12 comprises a solid portion 14 located between the base 13 and the tongues 18 (as described below). The dimensions of the solid portion 14 of the spatula 12 are of between 2.50 mm and 5 mm, preferably 3.30 mm in length, and of between 4 mm and 7 mm, preferably 5.20 mm in width, so as to have the same width as the widest portion of the base 13 to which said spatula is connected. The spatula comprises two applicator faces, the first applicator face opposing the second applicator face. The two applicator faces have identical surface areas. In an embodiment which is not shown, the two applicator faces are different.

The spatula also comprises an end edge 15, which is located opposite the base 13 and extends transversely in the direction X, and two lateral edges 16 and 17 which extend substantially in parallel with the direction X. Advantageously, the distal end of the spatula has a radius of curvature, thus providing the applicator with a curvature at the distal end thereof. The radius of curvature is of between 5 mm and 9 mm, preferably 7 mm. On account of said radius of curvature of the spatula, the user can apply the varnish to the nail far more precisely using the applicator according to the invention, since the nail has curved regions and the applicator can thus follow the curves of the nail.

The spatula 12 also comprises at least two tongues 18, each of the tongues 18 being separated by a longitudinal slit 19. Each of the tongues 18 likewise has an end which is connected to the solid portion 14 of the spatula 12 and is arranged in a plane which is perpendicular to the axis of extension X, and an opposite end.

Advantageously, the spatula also comprises at least two applicator tabs 20 which are formed in the extension of each tongue 18 in the region of the opposite end, each applicator tab 20 having a free end which forms the distal end $A_d$ of the applicator. The ends of the applicator tabs 20 are arranged in an arc and form the end edge 15 of the spatula. Each tab 20 is separated by a longitudinal slit 21.

Advantageously, the tongues 18 are wider than the applicator tabs 20. Indeed, the width of the tongues 18 is of between 1 mm and 2 mm, preferably 1.58 mm, whereas the width of the applicator tabs 20 is of between 0.10 mm and 0.30 mm, preferably 0.20 mm. The width of the tongues is of between 0.5 mm and 3 mm, preferably between 1 mm and 2.85 mm, whereas that of the tabs 20 is of between 1.5 mm and 5 mm, preferably 4 mm.

In the longitudinal extension direction (X), the length of the longitudinal slits 19 and 21 is sufficient to allow the tongues 18 and the tabs 20 a certain amount of flexibility, even suppleness. Indeed, the tongues 18 have a certain amount of flexibility. However, this flexibility is even more accentuated in the region of the applicator tabs 20 since said tabs are of a smaller width than the tongues 18. This flexibility of the tongues 18 and the tabs 20 is achieved by the fact that the tongues 18 and the tabs 20 are not rigidly connected to one another, thus making it possible for said tongues and tabs to separate from one another when the user presses the applicator face of the spatula onto the nail when applying the varnish in a direction which is substantially parallel to the rod. Indeed, two successive levels of flexibility are observed, according to the technique of applying varnish to the nail. The first level is achieved in the region of the tongues 18, the second in the region of the tabs 20, the level of flexibility being higher for the portion located closest to the distal end 15 of the applicator. Said double level of flexibility considerably improves the application of the varnish compared with: 1) tongues 18 alone, which are too rigid and therefore leave grooves of varnish on the nail, and 2) tabs 20 alone, which are too flexible and do not allow controlled application of the varnish.

Furthermore, the slits 19, 21 form containers which make it possible to remove and store varnish. The dimensions of the slits 19, 21 are determined such that the formula can be stored between two tongues 18 and/or two tabs 20 by means of capillary action. Advantageously, starting at the end edge 15 of the spatula, the slits 19 have a length of between 4.5 mm and 7 mm, preferably between 6 mm and 6.66 mm, whereas the slits 21 have a length of between 1.5 mm and 5 mm, preferably 4 mm. With regard to the width, that of the slits 19 is of between 0.1 mm and 0.4 mm, preferably 0.25 mm, whereas that of the slits 21 is of between 0.1 mm and 0.3 mm, preferably 0.15 mm.

The base 13 provides a join between the cylindrical end piece 11 and the flattened spatula 12. The base 13 is of a shape which narrows so as to form a continuous transition between the end piece 11 and the spatula 12. At the widest point, i.e. close to the spatula 12, the width of the base 13 is of between 4 mm and 7 mm, preferably 5.20 mm, whereas close to the end piece 11 the width of the base 13 is of between 2 mm and 4 mm, preferably 3 mm, so as to have the same width as the end piece 11 to which said base is connected. The length of the base 13 is of between 2 mm and 3 mm, preferably 2.50 mm.

Figure 3:
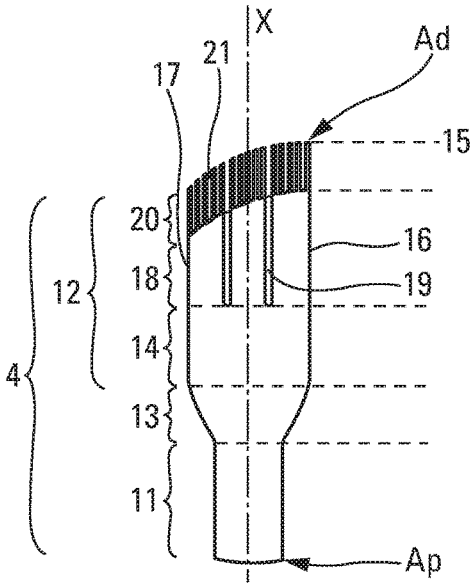
FIG. 3 is a schematic front view of an applicator of the spatula type according to a second embodiment of the invention.
Figure 4A:
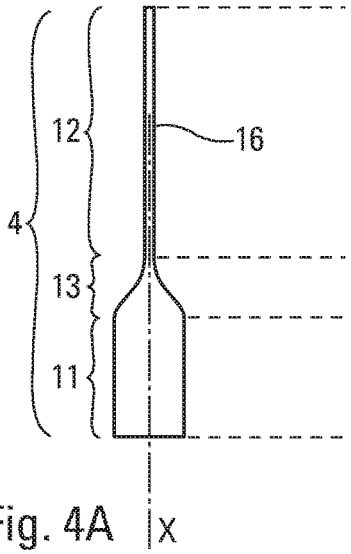
FIGS. 4A, 4B and 4C are schematic side views (4A and 4B) and a plan view (4C) of a spatula applicator according to the second embodiment of the invention.
Figure 4B:
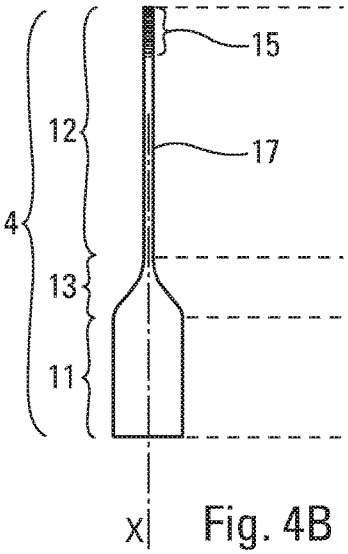
Figure 4C:
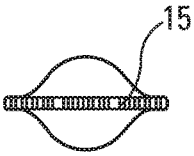

FIG. 3 is a schematic view of an applicator 4 according to a second embodiment of the invention.

As in the first embodiment, the applicator 4 extends in a longitudinal extension direction (X) and comprises a distal end, referred to as the distal end of the applicator $A_d$, and a proximal end, referred to as the proximal end of the applicator $A_p$. The applicator comprises an end piece 11, a spatula 12 and a base 13, said three elements being formed in a single piece from a polymer material.

FIGS. 3, 4A, 4B and 4C more precisely show the shape of the spatula 12 according to the second embodiment of the invention.

In this second embodiment, the number of tongues 18 and tabs 20 is increased. Indeed, there are three tongues 18, whereas there are five applicator tabs 20 in the extension of each of the three tongues 18 in the region of the opposite end thereof.

The applicator 4 according to the invention is made of a flexible polymer material, such as a thermoplastic elastomer or a silicone for example. The polymer material used has a hardness of between 30 and 100 Shore A, preferably of between 50 and 85 Shore A, in order to provide the applicator with a flexibility which is appropriate for the intended use. In addition, the polymer material is selected such that the dimensions of the applicator 4 change by less than or equal to 10%, preferably less than or equal to 3%, when the applicator 4 is immersed for a month in a nail varnish 9 maintained at a temperature of 40° C.

The thermoplastic elastomer material can be selected from thermoplastic olefin (TPO) polymers such as Hytrel®, ethylene propylene diene monomer-polypropylene (EPDM-PP) copolymers such as Santoprene®, styrene-butadiene-styrene (SBS) sequenced triblock copolymers, styrene-ethylene/butylene-styrene (SEBS) sequenced copolymers, thermoplastic polyurethanes (TPU) such as Desmopan®, polyether block amide (PEBA) copolymers such as Pebax®, and ethylene/alpha-olefin copolymers such as Exacta®.

Although the invention has been described above on the basis of examples of the preferred embodiments thereof, it is to be understood that it can be modified without departing from the spirit and the nature of the invention as defined in the accompanying claims.

The invention claimed is:

1. An applicator for a liquid or viscous cosmetic which extends in a longitudinal extension direction (X) and comprises a distal end, referred to as the distal end of the applicator $A_d$, and a proximal end, referred to as the proximal end of the applicator $A_p$, the applicator comprising:

an end piece, at the proximal end $A_p$, which can be attached to a rod of an applicator assembly, a spatula, at the distal end $A_d$, a base which connects the end piece and the spatula, the end piece, the base and the spatula being a single piece made of a polymer material, wherein the spatula comprises:

at least two tongues, each having an end connected to a solid portion of the spatula and an opposite end, and each tongue being separated by a longitudinal slit, at least two applicator tabs formed in the extension of each tongue in the region of the opposite end, each tab having a free end which forms the distal end of the applicator, and wherein the tongues and the tabs are not rigidly connected to one another.

2. Applicator according to claim 1, wherein the tongues are wider than the applicator tabs.

3. Applicator according to claim 1, wherein the ends of the tongues connected to the solid portion of the spatula are arranged in a plane which is perpendicular to the axis of extension X.

4. Applicator according to claim 1, having a certain degree of flexibility in the region of the tongues, said flexibility being even more accentuated in the region of the applicator tabs.

5. Applicator according to claim 1, wherein the ends of the applicator tabs are arranged in an arc.

6. Applicator according to claim 1, wherein there are three tongues and five applicator tabs.

7. Applicator according to claim 1, wherein the spatula has a planar profile.

8. Applicator according to claim 1, the distal end of which has a radius of curvature.

9. Applicator according to claim 1, wherein the polymer material has a hardness of between 30 and 100 Shore A.

10. Applicator according to claim 1, wherein the polymer material has a hardness of between 50 and 85 Shore A.

11. Applicator according to claim 1, wherein the polymer material is a thermoplastic elastomer material or a silicone material.

12. Applicator according to claim 11, wherein the thermoplastic elastomer material is selected from the group consisting of a thermoplastic olefin (TPO) polymer, an ethylene propylene diene monomer-polypropylene (EPDM-PP) copolymer, a styrene-butadiene-styrene (SBS) sequenced triblock copolymer, a styrene-ethylene/butylene-styrene (SEBS) sequenced copolymer, a thermoplastic polyurethane (TPU), a polyether block amide (PEBA) copolymer, an ethylene/alpha-olefin copolymer.

13. Packaging assembly for nail varnish, comprising:

a receptacle containing nail varnish, a rod, at the proximal end $T_p$ a cap that can be attached to a neck of the receptacle, and at the distal end $T_d$ an applicator 4 according to claim 1.

* * * * *